US007947003B2

(12) United States Patent
Bonnefin et al.

(10) Patent No.: US 7,947,003 B2
(45) Date of Patent: May 24, 2011

(54) PRESSURIZED MEDICAL DEVICE

(75) Inventors: Wayne Lee Bonnefin, Neston (GB); Duncan John Rowley, Greasby (GB); Henrik Landhal, Lund (SE); Roland Larsson, Staffanstorp (SE); Arsenio Fernandez, Brackla (GB)

(73) Assignee: ConvaTec Technologies Inc., Las Vegas, NV (US)

( * ) Notice: Subject to any disclaimer, the term of this patent is extended or adjusted under 35 U.S.C. 154(b) by 1037 days.

(21) Appl. No.: 11/626,058

(22) Filed: Jan. 23, 2007

(65) Prior Publication Data

US 2007/0249977 A1 Oct. 25, 2007

(30) Foreign Application Priority Data

Jan. 24, 2006 (GB) ..... 0601453.4

(51) Int. Cl.
*A61H 9/00* (2006.01)

(52) U.S. Cl. ..... 601/150; 601/151

(58) Field of Classification Search ..... 601/148, 601/149, 150, 151, 152; 602/13; 606/201, 606/202

See application file for complete search history.

(56) References Cited

U.S. PATENT DOCUMENTS

| | | | | |
|---|---|---|---|---|
| 5,443,440 | A | 8/1995 | Tumey | |
| 5,741,294 | A | 4/1998 | Stromberg | |
| 5,838,244 | A | 11/1998 | Schmidt | |
| 6,786,879 | B1 | 9/2004 | Bolam | |
| 2004/0059274 | A1 | 3/2004 | Kloecker | |
| 2004/0111048 | A1 | 6/2004 | Jensen | |
| 2005/0154336 | A1 * | 7/2005 | Kloecker et al. | 601/148 |
| 2005/0159690 | A1 | 7/2005 | Barak | |
| 2005/0187500 | A1 | 8/2005 | Perry | |

FOREIGN PATENT DOCUMENTS

| | | |
|---|---|---|
| DE | 4100501 | 7/1992 |
| EP | 0342249 | 1/1991 |
| EP | 0813047 | 12/1997 |
| EP | 1226804 | 7/2007 |
| WO | WO2004005858 | 1/2004 |

* cited by examiner

*Primary Examiner* — Quang D Thanh
(74) *Attorney, Agent, or Firm* — John M. Kilcoyne

(57) ABSTRACT

A pressurized medical device comprising an inflatable element arranged to contact a part of a patient; a fluid connector attached to the element and arranged to deliver fluid to the element; a control system arranged to control flow of fluid in the device; a first element pressure sensor arranged to measure the pressure exerted by the element on the part of the patient; and detection means arranged to detect malfunctioning of the first element pressure sensor.

5 Claims, 5 Drawing Sheets

PRESSURIZED MEDICAL DEVICE

This invention relates to pressurized medical devices. For example, the invention relates to a compression device for the limb and, particularly, to a device for use on the leg. For example, the device may be used for compression therapy used in the treatment of venous leg ulcers.

BACKGROUND OF THE INVENTION

Various compression devices are known for applying compressive pressure to a patient's limb. These types of devices are used to assist mainly in the prevention of deep vein thrombosis (DVT), vascular disorders and the reduction of oedema. U.S. Pat. No. 6,786,879 and U.S. Patent Publication No. 2004/0111048 disclose such devices.

Compression therapy is used in the treatment of venous leg ulcers. The treatment relies on the compression achieving a reduction in oedema and improved return of blood via the venous system. This in turn reduces the residence time for blood supplied to the lower limb and the severity of ischaemic episodes within the limb that can result in tissue breakdown.

Compression of the limb in the treatment of venous leg ulcers is most usually achieved by the use of elastic bandages. Elastic bandages have the advantages that the patient can be mobile, can be treated at home and that once applied by a health care professional any removal or interference may be possible to detect. Elastic bandages do, however, have many disadvantages. They can work loose, the pressure generated by the bandage on the limb is not measured and depends on the level of skill of the health care professional applying the bandage, the level of compression is also affected by the circumference of the limb, the bandage cannot be removed and reapplied by the patient, for instance for bathing, and many patients find them unsightly, uncomfortable, hot or painful.

Compression of the limb in the treatment of venous leg ulcers can also be achieved by the use of compression stockings, although they are most often used in the prevention of leg ulcers for instance in the prevention of recurrence after an active leg ulcer has healed. Compression stockings have many of the advantages of elastic bandages, they can be used at home and the patient can be mobile. They, however, have some disadvantages. They are difficult to apply as the narrow ankle part has to be pulled over the heel, compliance with treatment is difficult to monitor as the patient may be able to remove and replace the stocking themselves and patients can find them uncomfortable.

Compression of the limb can also be achieved by a pneumatic compression device. As venous leg ulcers are most usually treated at home or in the community and the known compression devices are large, heavy and require professional supervision, their adoption for such treatment has not been widespread. The known devices used previously apply pressure to the limb through a thick cuff or cuffs which affect patient mobility and are aesthetically unacceptable to many patients. The pump which produces the compression is large and heavy and can supply fluid to the cuffs through many pipes. These characteristics make the known devices unsuitable for home use.

Pneumatic compression devices have the following advantages: They provide an effective treatment; while deflated, the inflatable cuff or cuffs are easy to apply to the patient's leg; and the pressure is more readily controlled and monitored.

Compression devices typically have inflatable sleeves and can have an associated pressure sensor which measures pressure exerted by the sleeve when in use upon the limb of a patient. The measured pressure can be used for a variety of reasons. For example, it can be used by a healthcare professional, e.g., a doctor, in order to obtain information about use of the product. This can be useful when the doctor is not in attendance while the compression device is being used. Data relating to the pressure exerted by the sleeve on the patient's limb can be stored for later analysis by the healthcare professional. Additionally, the measured pressure readings can be used by a control system of the compression device to subsequently calculate a pressure to be applied to a patient's limb. Other uses for measured pressure readings will also be apparent to a person skilled in the art. It is important that the measured pressure reading is accurate.

SUMMARY OF THE INVENTION

A first embodiment of the invention is a pressurized medical device comprising: an inflatable element arranged to contact a part of a patient; a fluid connector attached to the element and arranged to deliver fluid to the element; a control system arranged to control flow of fluid in the device; a first element pressure sensor arranged to measure the pressure exerted by the element on the part of the patient; and a detection means arranged to detect malfunctioning of the first element pressure sensor.

Preferably, the detection means is arranged to detect whether the first element pressure sensor is malfunctioning by detecting whether it is functioning accurately to within a predetermined degree of accuracy. The detection means, preferably, comprises a reference pressure sensor arranged to independently measure the pressure exerted by the element on the part of the patient, where the first element pressure sensor measures pressure in a fluid line comprising the first connector and the reference pressure sensor measures pressure independently in the same fluid line.

The detection means is arranged to detect malfunctioning by measuring pressure difference between values read by the first element and reference pressure sensors and comparing them to a known relative pressure difference value for a non-malfunctioning first element pressure sensor. The relative pressure difference is, preferably, substantially zero and is shown as a difference in readings of around 15 mm Hg or less.

The control system is arranged to control fluid flow dependent on the pressure measured by the first element pressure sensor. The system is, preferably, arranged to control the fluid flow to reduce pressure if the detection means detects that the first element pressure sensor is malfunctioning and, more preferably, is arranged to reduce pressure to substantially zero.

The control system comprises a pump and a controller unit. The pressurized medical device comprises a compression device for a limb of a patient, the inflatable element comprises an inflatable sleeve arranged to surround the limb and exert a pressure on the limb, the fluid connector comprises a conduit attached to the sleeve arranged to deliver fluid to the sleeve, and the first element pressure sensor comprises a first sleeve pressure sensor arranged to measure the pressure exerted by the sleeve on the limb. Preferably the inflatable element comprises one or more individually inflatable cells. Each cell, preferably, has an associated element pressure sensor arranged to determine the pressure exerted by the cell. Separate fluid connectors are attached to each cell and are arranged to deliver fluid to each cell and each associated element pressure sensor is located in each fluid connector. The control system is arranged to control fluid flow to reduce pressure only in cells which have associated element pressure sensors which have been determined as malfunctioning. Preferably, a valve arrangement is arranged so as to selectively allow or prevent fluid flow through each fluid connector and the control system is arranged to control the valve arrangement such that more than one cell cannot be inflated or deflated simultaneously. Alternatively, a valve arrangement is arranged to selectively allow or prevent fluid flow through each fluid connector and the control system is arranged to control the valve arrangement such that more than one cell can be inflated or deflated simultaneously. For example, a single fluid connector could be used to supply fluid to more than one cell. In such examples, the cells connected to the same fluid connector may exert the same pressure as each other.

Each pressure sensor may comprise a fluid pressure sensor arranged to measure fluid pressure. Alternatively, each pressure sensor may comprise a contact pressure sensor arranged to measure contact pressure.

Preferably, the pressured device is for the limb of a mobile patient.

The detection means is arranged to check for malfunctioning of the or each element pressure sensor periodically, continuously, from time to time at preset or random intervals, every time the device is used or at any other suitable time when the device is used.

The control system is, preferably, arranged to control the fluid flow to reduce the exerted pressure to substantially zero if an element pressure sensor detects a pressure exceeding a first predefined amount. Preferably, the control system is arranged to control the fluid flow to reduce the exerted pressure to substantially zero if the reference pressure sensor detects a pressure exceeding a second predefined amount. Preferably, the second predefined amount is greater than the first predefined amount. The control system comprises a first processor arranged to determine whether the pressure exceeds a first predefined amount and a second processor, distinct from the control system, arranged to determine whether the pressure exceeds the second predefined amount. Alternatively, the control system comprises a first processor arranged to determine whether the pressure exceeds the first pre-defined amount and a hardware unit, distinct from the control system, arranged to determine whether the pressure exceeds the second pre-defined amount.

DETAILED DESCRIPTION OF THE INVENTION

Figure 1:
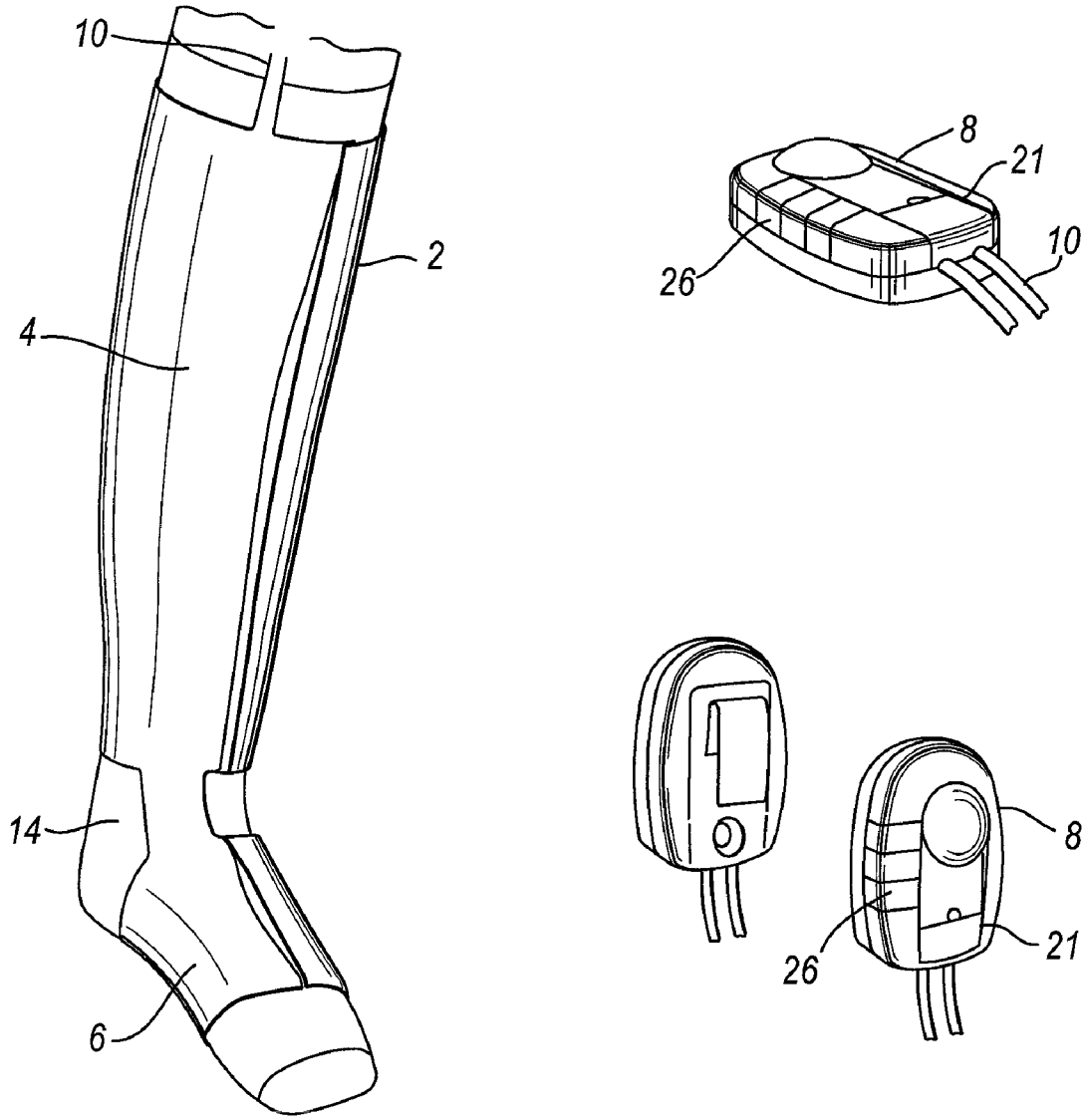
FIG. 1 is a perspective view of the sleeve of a first embodiment of the device on the limb and the controller.
Figure 2:
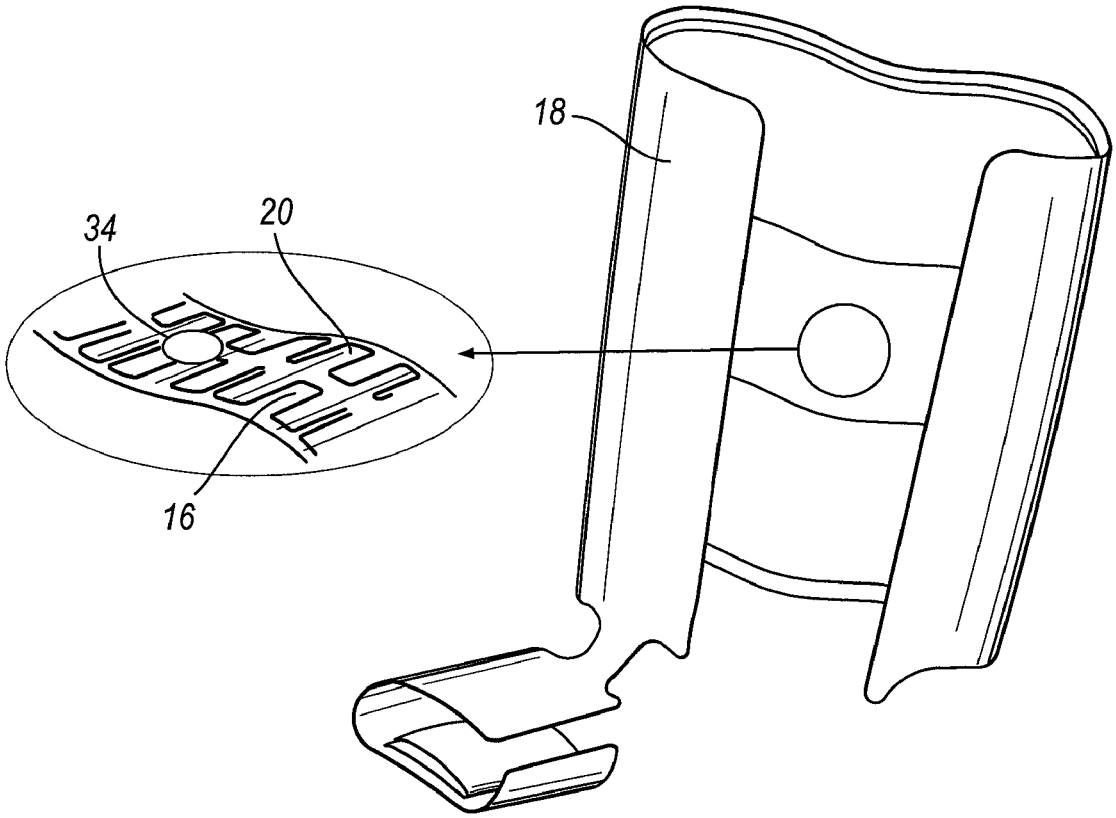
FIG. 2 is a perspective view of the sleeve of the device off the limb and opened up.

In FIG. 1 a compression device according to a first embodiment of the invention is shown on the leg of a patient in a standing position. The device comprises a sleeve 2 having a leg cuff 4 connected to a foot cuff 6. The device also comprises a control system housed within a controller unit 8. The sleeve 2 is connected to the controller unit 8 by a fluid connector in the form of a conduit 10. The controller unit 8 is a small, hand held unit that may be clipped to the sleeve 2 or to the waistband of the patient's trousers or skirt. The controller unit 8 is battery powered, by a rechargeable battery. The device also comprises an understocking 14 worn between the patient's leg and the sleeve 2. The understocking 14 is present to absorb any moisture from the patient's leg but does not apply compression. The sleeve 2 has an inner surface 16 and an outer surface 18 composed of a durable flexible material that can be sponged clean and is divided into a plurality of minicells 20 best seen in FIG. 2.

The controller unit 8 comprises a display 21, a user input in the form of a row of buttons 26, a microprocessor 28, a memory 30, and a pump and valve arrangement 32. A sleeve pressure sensor 34 is attached to the sleeve 2 and located between the sleeve 2 and the limb and provides readings of the pressure experienced by the limb due to inflation of the sleeve 2 by the control system. In this embodiment the sleeve pressure sensor 34 is a contact pressure sensor. The microprocessor 28 is able to read data from and write data to the memory 30. Operation of the control system by a user is achieved via the user input 26.

In use, the sleeve pressure sensor 34 provides information relating to the pressure exerted by the sleeve 2 on the limb. The microprocessor 28 is able to determine the length of time for which the sleeve 2 is inflated and in place surrounding the limb. This data is stored in the memory 30. The compression device operates in a continuous pressure mode. In this continuous pressure mode a patient or healthcare professional uses the buttons 26 to input a desired constant pressure which is required to be applied to the limb via the sleeve 2. The microprocessor 28 arranges for inflation of the sleeve 2 to the required pressure. The sleeve pressure sensor 34 is used to determine when the required pressure has been reached. If, during the course of time, the pressure being exerted by the sleeve 2 on the limb falls below a required level it is detected by the sleeve pressure sensor 34 and the microprocessor 28 communicates with the pump and valve arrangement 32 in order to inflate the sleeve 2 back up to the required level of pressure.

The microprocessor 28 runs a timer program to measure the length of time for which the pressure being applied by the sleeve 2 is at a particular level. This data is stored in the memory 30. Using the user input buttons 26, the user can specify the length of time for which the sleeve 2 should remain inflated. After this length of time has expired the microprocessor 28 arranges for deflation of the sleeve 2.

In other embodiments the pressure to be exerted on the limb and the amount of time for which the pressure is to be exerted is pre-programmed on the microprocessor 28. In such embodiments, when the controller unit 8 is turned on, the pre-programmed treatment begins. There is no need for a user to input details of the required pressure or duration.

Using the user input buttons 26, the healthcare professional can request details of use of the device to be shown on the display 21, by, for example, inputting a personal identification number (PIN).

In other embodiments there is no need to enter a PIN and the display 21 may automatically default to a screen which shows details of use of the device. For example, in another embodiment, the controller unit 8 does not have a conduit 10 which is in the form of an umbilical type cord. In such embodiments the controller unit 8 may be fitted, e.g., snap-fitted, onto the sleeve 2 in use. When the controller unit 8 is removed from the sleeve 2 its display 21 defaults automatically to showing details of use of the device.

The compression device also comprises detection means which is arranged to detect malfunctioning of the sleeve pressure sensor 34. In this embodiment the detection means comprises a reference fluid pressure sensor 50. The reference fluid pressure sensor 50 is located in the conduit 10 between the controller unit 8 and the sleeve 2 in order to measure the pressure in the conduit 10, i.e., it is located in the same fluid line as the sleeve pressure sensor 34 and is arranged to independently measure pressure in the fluid line.

The microprocessor 28 is arranged to compare measurements obtained from the sleeve pressure sensor 34 and the fluid pressure sensor 50 in order to determine whether or not the sleeve pressure sensor 34 is malfunctioning. In this embodiment the sleeve 2 is typically inflated up to pressures of about 50 mm Hg (6.7 kPa). In this embodiment, for such pressures, the microprocessor 28 is arranged to determine that the sleeve pressure sensor 34 is malfunctioning if the pressures measured by the sleeve pressure sensor 34 and the reference fluid pressure sensor 50 are not within 13 mm Hg of each other. Also, in this embodiment in order to provide more reliable determinations, ten consecutive pressure measurements are taken by each sensor and the average difference between them is analyzed. The measurements are made within one second of each other in this embodiment. If the average difference between the measured pressures is not more than 13 mm Hg, then the microprocessor 28 determines that the sleeve pressure sensor 34 is functioning correctly. If the average difference between the pressures measured by the sleeve pressure sensor 34 and the reference fluid pressure sensor 50 is greater than 13 mm Hg, then the microprocessor 28 determines that the sleeve pressure sensor 34 is malfunctioning. This is undesirable since it can be important to accurately know the pressure exerted by the sleeve 2 on the limb. For example, it can be dangerous if the compression device is exerting a pressure greater than required on the limb of a patient. Also, if usage data relating to the pressure being exerted on the limb at a particular time is being stored in the memory 30 for later analysis by a healthcare professional, then inaccurate stored data can lead to an incorrect determination of the correct subsequent medical treatment required by a patient. Therefore, if the microprocessor 28 determines that the sleeve pressure sensor 34 is malfunctioning, then it is arranged to instruct the pump and valve arrangement 32 to control fluid flow to the sleeve 2 such that the pressure exerted by the sleeve 2 is reduced to substantially zero. In other embodiments the fluid flow may be controlled such that the pressure is significantly reduced. However, in this embodiment the pressure is reduced to zero since, advantageously, this cannot lead to a situation where a limb is put under more pressure than it should be during the course of a prescribed treatment.

In other embodiments, more or less than ten readings may be taken and their average used as an indication of the pressure exerted by the sleeve 2 upon the limb. Also, in this embodiment, pressures measured by the sleeve pressure sensor 34 and the reference fluid pressure sensor 50 are required to be within 13 mm Hg of each other—this amounts to about 15% of the typical inflation pressure of the sleeve 2. In other embodiments, if more accuracy is required, then a smaller percentage error may be provided. If less accuracy is needed, then a greater percentage error may be allowable.

Figure 3:
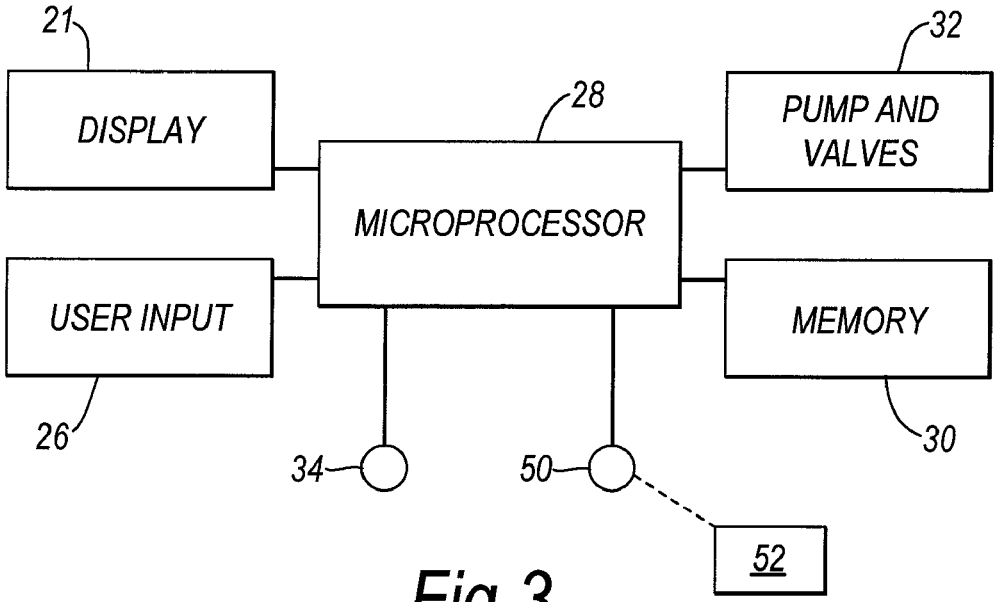
FIG. 3 is a schematic diagram of the functional units of the control system of the device.

In a further embodiment of the invention, the microprocessor 28 is arranged to run software which causes it to monitor the pressure measured by the sleeve pressure sensor 34. If this measured pressure exceeds 70 mm Hg (9.3 kPa) for a duration of more than five seconds, then the microprocessor 28 is arranged to instruct the pump and valve arrangement 32 to reset the pressure being applied back down to a safe pressure level. In this embodiment, the safe pressure level is 65 mm Hg (8.7 kPa). In other embodiments the safe pressure level may be defined as a different value of pressure. Also in other embodiments, the pressure may be monitored over a greater or smaller duration. In addition, a distinct monitoring hardware unit 52 is arranged to monitor the pressure measured by the reference fluid pressure sensor 50. The hardware unit 52 is represented in FIG. 3, but is not an essential feature of the previously described embodiment. The hardware unit 52 provides an independent measure of the pressure exerted on the limb by the inflatable sleeve 2. In this embodiment, if a pressure greater than 80 mm Hg (10.7 kPa) is observed for a duration of more than ten seconds, then the hardware unit 52 will automatically reset the pressure back down to the safe pressure level. In some embodiments the hardware unit 52 will shut down the fluid flow in the device altogether. Both of these cut off mechanisms operate continuously and data from the previous five or ten second periods is used to determine whether or not the compression device is operating at a safe level. In other embodiments different time periods can be used. Advantageously, the hardware unit 52 determination provides a back up for the determination made by the microprocessor 28 of the control system. Therefore, if the microprocessor 28 and control system fail then the hardware unit 52 should be able to identify this failure and safely reduce the pressure in the compression device.

Figure 4:
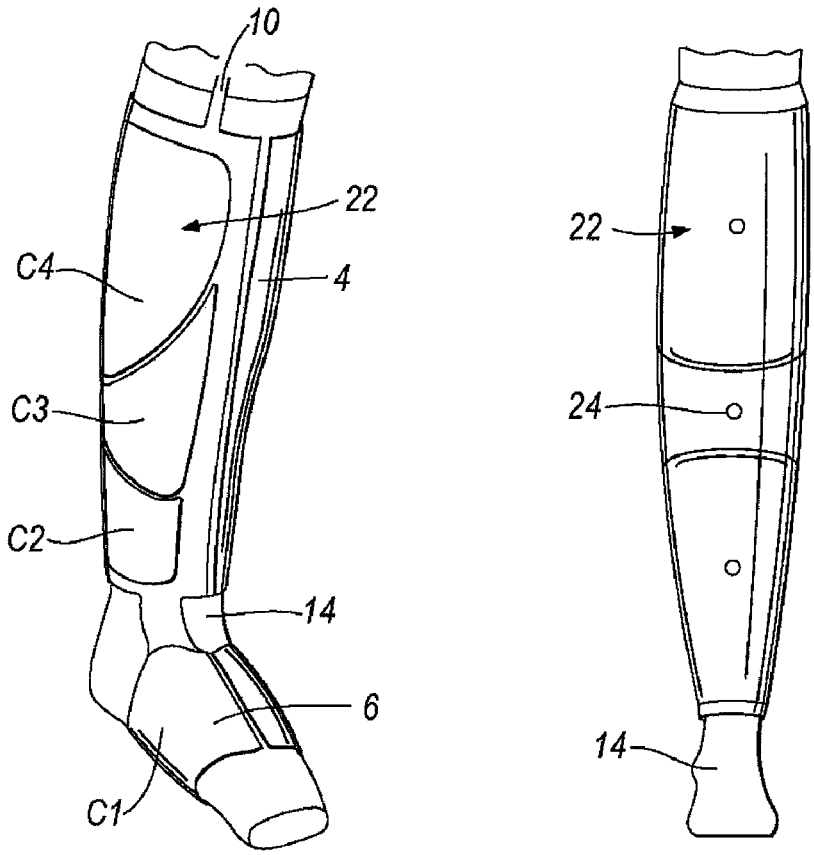
FIG. 4 shows two perspective views of the sleeve of a second embodiment of the device on the limb.

FIG. 4 shows a device according to a further embodiment of the invention where the leg cuff 4 and foot cuff 6 comprise cells with an anatomical shape 22.

Four cells are provided in this embodiment—a foot cell C1, a lower cell C2, a middle cell C3 and an upper cell C4 (see FIG. 4). Each cell C1, C2, C3 and C4 has an associated fluid pressure sensor S1, S2, S3, S4, respectively, and the fluid pressure sensor is arranged to provide an indication of the pressure exerted by each cell C1, C2, C3, C4 upon the leg. The location of each fluid pressure sensor S1, S2, S3, S4 is described in more detail below.

In this embodiment, the control system associated with the device is similar to the control system of the device according to the first described embodiment except that there are four fluid sleeve pressure sensors S1, S2, S3, S4 instead of only one contact sleeve pressure sensor 34.

Figure 5:
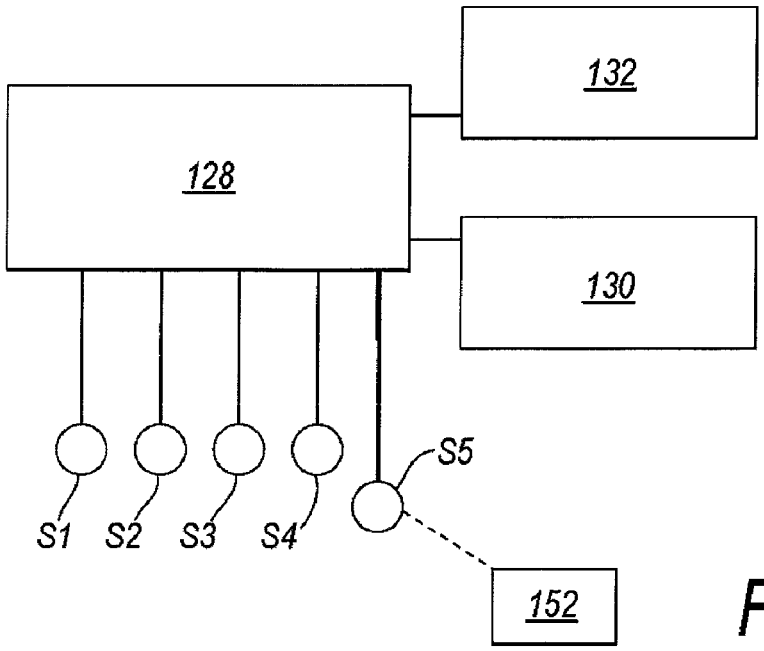
FIG. 5 is a schematic diagram of the functional units of the control system of the device of FIG. 4.

Referring to FIG. 5, a control system in this embodiment includes a microprocessor 128 in communication with a memory 130 and a pump and valve arrangement 132. In this embodiment there is no display or user input and it should be understood that these are not essential for the invention. The microprocessor 128 is able to communicate with the fluid pressure sensors S1, S2, S3, S4. The microprocessor 128 is also in communication with a reference sensor S5 which is arranged to provide an indication of the pressure within the fluid flow system of the compression device (described in more detail below).

Figure 6:
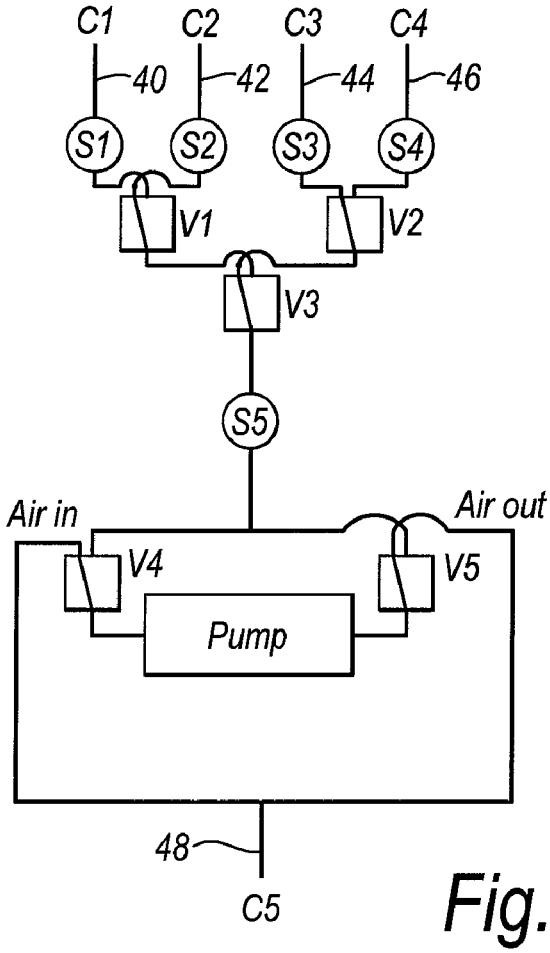
FIG. 6 is a schematic air flow logic diagram of the functional units of the device of FIG. 4.
Figure 7:
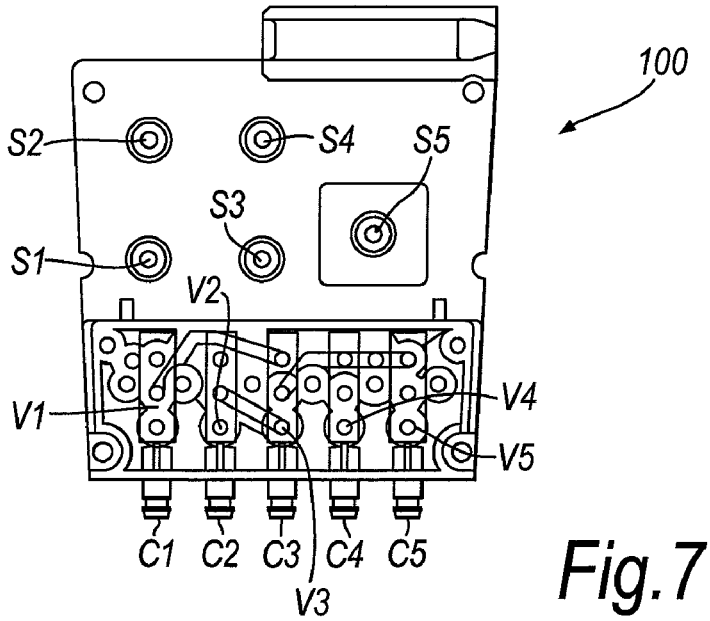
FIG. 7 is a schematic sectional view of a manifold of the device of FIG. 4.

Referring to FIGS. 6 and 7, a manifold 100 has fluid flow conduits 40, 42, 44, 46, 48 which lead to the cells C1, C2, C3, C4 and an air inlet/outlet C5, respectively. Referring to FIG. 6, when a cell C1, C2, C3, C4 is required to be inflated, air is taken in via the conduit 48 by operation of the pump and valves V4, V5 under instruction from the microprocessor 128. The microprocessor 128 instructs valves V1, V2, V3 which are arranged between the air inlet/outlet C5 and the conduits 40, 42, 44, 46 such that only one of these conduits is operable, i.e., open to fluid flow, at any one time. From FIG. 6 it can be seen that valve V3 directs fluid from/to the air inlet/outlet C5 to/from either valve V1 or V2, which in turn selectively open or close fluid paths to either cell C1 or C2 or either cell C3 or cell C4. respectively. A fluid pressure sensor S1 is located in conduit 40 between cell C1 and valve V1 in the controller unit 100. Similarly, fluid pressure sensors S2, S3 and S4 are located in conduits 42, 44 and 46, respectively. Fluid pressure sensors S1, S2, S3 and S4 are all controlled by the microprocessor 128 and arranged to provide an indication of pressure exerted by their respective cells C1, C2, C3, C4 on the leg. Reference sensor, S5 independently monitors the pressure in the fluid flow system of the pressure device and since only one fluid path 40, 42, 44, 46 is able to be open at any one time, the reference sensor S5 is always in the same fluid path as whichever sleeve fluid pressure sensor S1, S2, S3, S4 is in the open fluid path. The microprocessor 128 is able to compare measured pressure values from reference sensor S5 and whichever of fluid pressure sensors S1, S2, S3, S4 corresponds to the open fluid path in order to check whether the relevant sleeve fluid pressure sensor S1, S2, S3, S4 is functioning correctly or malfunctioning. The measurements used to make this determination are similar to those in the previously described embodiment.

In other embodiments, it may be possible to have more than one fluid path open at any one time using a different pump and valve arrangement 32. Also similarly to the first described embodiment, the microprocessor 128 continuously checks whether the pressure measured by fluid pressure sensors S1, S2, S3, S4 exceeds a desired maximum safe pressure. If so, the pressure in the system can be reduced or cut off altogether as with the first described embodiment.

Also, a hardware unit 152 is able to interrogate the reference sensor S5 in order to determine whether the pressure in the fluid flow system has exceeded a safe level. If it has, the pressure can be reduced or preferably cut off altogether as previously described.

Figure 8:
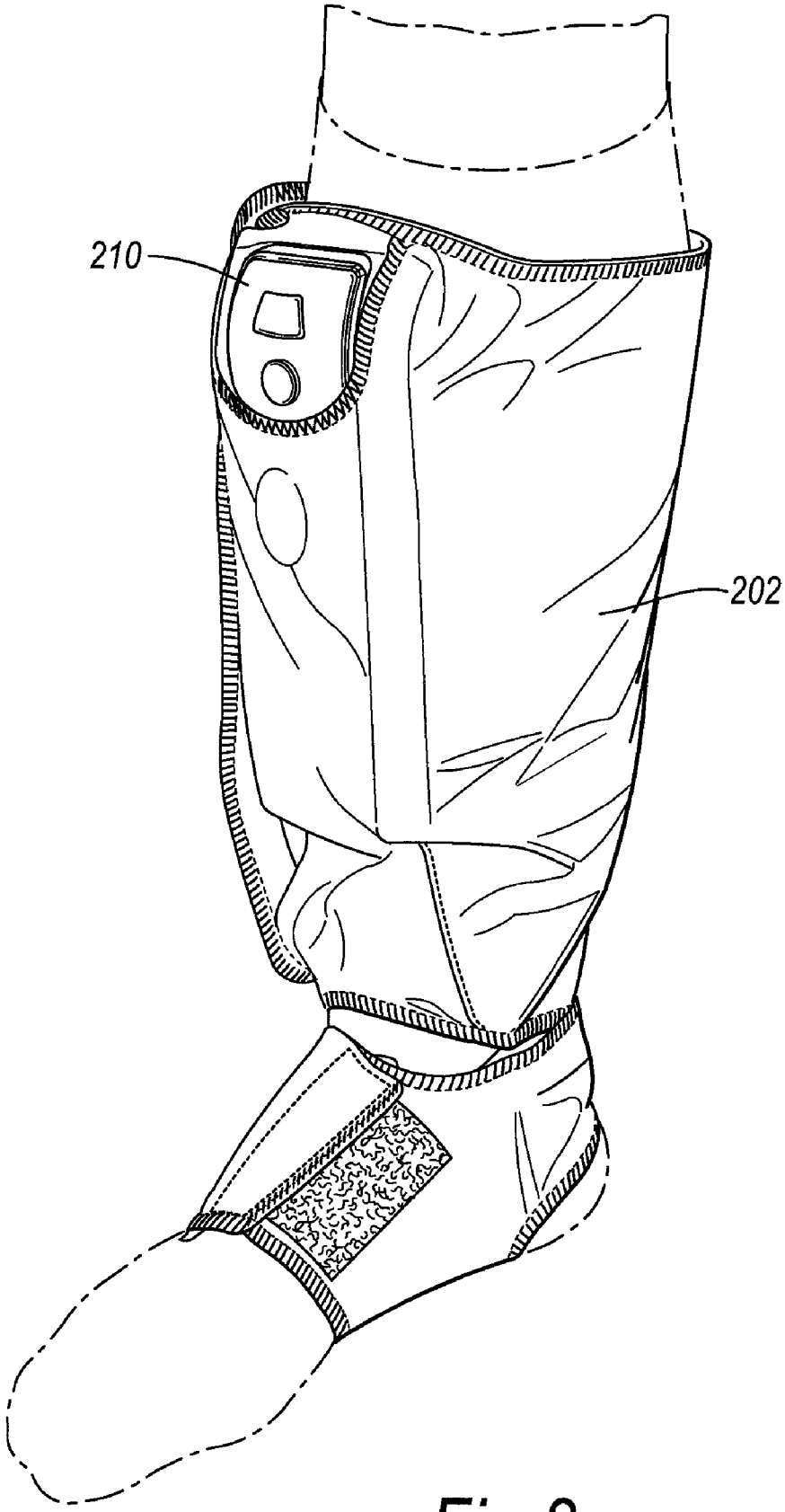
FIG. 8 is a perspective view of a sleeve and controller according to a further embodiment of the device on the limb.

Referring to FIG. 8, a compression device according to a further embodiment of the invention is shown on the leg of the patient. The device is functionally similar to the device of the previous embodiment but includes a controller unit 210 which is able to be placed within a pouch provided on the inflatable sleeve 202. The inflatable sleeve 202 comprises cells similarly to the device shown in FIG. 4. The controller unit 210 does not have an umbilical cord running from it in order to communicate within the inflatable sleeve 202. Instead when the controller unit 210 is correctly in place inside the pouch, it is arranged to be aligned with a fluid connector (not shown) which allows correct inflation/deflation of the inflatable sleeve 202. The controller unit 210 is arranged to be snap-fitted into place in order to obtain correct alignment with the fluid connector (not shown). In other embodiments, different alignment means may be provided.

Various modifications may be made to the present invention without departing from its scope. For example, the controller unit 8, 210 may not have a user input. Instead, for example, the system can receive inputs from e.g., a keyboard of a computer or other processing device when it is in communication (e.g., infrared).

Also it is not necessary for the compression device to be arranged to provide a constant pressure to each cell or to the sleeve (if there is only one cell). Instead, it may operate in a different type of mode which requires a variation in pressure at different times for example.

The pressured medical device may not be a compression device for the limb. For example, it may be an inflatable mattress such as a pressure offloading mattress.

We claim:

1. A pressurized medical device for a limb of a patient comprising:

a. an inflatable sleeve arranged to surround the limb and exert pressure on the limb, said sleeve comprising one or more individually inflatable cells wherein each cell has an associated pressure sensor arranged to determine the pressure exerted by the cell;

b. a fluid connector comprising a conduit attached to the sleeve and arranged to deliver fluid to the sleeve;

c. detection means arranged to detect malfunctioning of a pressure sensor, the detection means comprising a reference pressure sensor arranged to independently measure the pressure exerted by the sleeve on the limb of the patient; and d. a control system arranged to control flow of fluid in the device to reduce the exerted pressure to substantially zero if a pressure sensor detects a pressure exceeding a first predefined amount, and to reduce the exerted pressure to substantially zero if the reference pressure sensor detects a pressure exceeding a second predefined amount, said second predefined amount being greater than the first predefined amount.

2. The pressurized medical device of claim 1 for the limb of a mobile patient.

3. The pressurized medical device of claim 1, wherein the detection means is arranged to check for malfunctioning of a pressure sensor periodically, continuously, from time to time at preset or random intervals, every time the device is used or at any other suitable time when the device is used.

4. The pressurized medical device of claim 1, wherein the control system comprises a first processor arranged to determine whether the pressure exceeds the first predefined amount and a second processor, distinct from the control system, arranged to determine whether the pressure exceeds the second predefined amount.

5. The pressurized medical device of claim 1, wherein the control system comprises a first processor arranged to determine whether the pressure exceeds the first pre-defined amount and a hardware unit, distinct from the control system, is arranged to determine whether the pressure exceeds the second pre-defined amount.

* * * * *